US007763116B2

(12) United States Patent
Carter et al.

(10) Patent No.: US 7,763,116 B2
(45) Date of Patent: Jul. 27, 2010

(54) PROCESS FOR THE RECOVERY OF SUCROSE AND/OR NON-SUCROSE COMPONENTS

(75) Inventors: Mel Carter, Maribo (DK); John P. Jensen, Naksko (DK)

(73) Assignee: Danisco A/S, Copenhagen K. (DK)

( * ) Notice: Subject to any disclaimer, the term of this patent is extended or adjusted under 35 U.S.C. 154(b) by 818 days.

(21) Appl. No.: 11/643,440

(22) Filed: Dec. 21, 2006

(65) Prior Publication Data

US 2007/0169772 A1 Jul. 26, 2007

Related U.S. Application Data

(60) Provisional application No. 60/752,655, filed on Dec. 21, 2005.

(30) Foreign Application Priority Data

Dec. 21, 2005 (GB) ..... 0526034.4

(51) Int. Cl.
*C13J 1/06* (2006.01)

(52) U.S. Cl. ..... 127/46.1; 127/42; 127/46.2; 127/53; 127/58

(58) Field of Classification Search ..... 127/46.2, 127/42, 53, 54, 58
See application file for complete search history.

(56) References Cited

U.S. PATENT DOCUMENTS 3,781,174 A 12/1973 Nishijima et al.
3,799,806 A 3/1974 Madsen
4,083,732 A 4/1978 Paley
4,331,483 A 5/1982 Mirabel et al.
4,492,601 A 1/1985 Nakasone et al.
4,711,722 A 12/1987 Toyoshi et al.

(Continued)

FOREIGN PATENT DOCUMENTS

EP 0 345 511 12/1989

(Continued)

OTHER PUBLICATIONS

Florence Lutin, "Electrodialysis as a purification technology in the sugar industry" Zuckerindustrie 125, 2000, pp. 982-984, Nr. 12.

(Continued)

*Primary Examiner*—Jennifer K Michener
*Assistant Examiner*—Heng M Chan
(74) *Attorney, Agent, or Firm*—Scully, Scott, Murphy & Presser, P.C.

(57) ABSTRACT

The invention relates to an industrially useful process for the recovery of sucrose and/or non-sucrose components. The process comprises (i) providing a solution of sugar beet and/or sugar cane origin selected from molasses, sugar juices and liquors, wherein said sugar juices are non-nanofiltered during the process; (ii) subjecting said solution to electrodialysis for removing therefrom inorganic and organic anions and cations and organic acids; (iii) subjecting the electrodialyzed solution to a chromatographic separation for obtaining sucrose and non-sucrose components in separate fractions; and (iv) recovering a product selected from sucrose and non-sucrose components from at least one of said fractions. The invention also relates to the use of electrodialysis for improving the efficiency of chromatographic separation in the industrial recovery of sucrose and/or non-sucrose components.

26 Claims, 3 Drawing Sheets

U.S. PATENT DOCUMENTS

| | | | | |
|---|---|---|---|---|
| 5,466,294 | A * | 11/1995 | Kearney et al. | 127/42 |
| 5,795,398 | A | 8/1998 | Hyoky et al. | |
| 6,224,776 | B1 | 5/2001 | Heikkila et al. | |
| 6,352,845 | B1 | 3/2002 | Buchanan et al. | |
| 6,406,547 | B1 | 6/2002 | Donovan et al. | |
| 6,586,212 | B1 | 7/2003 | Buchanan et al. | |

FOREIGN PATENT DOCUMENTS

| | | |
|---|---|---|
| JP | 58-082124 | 5/1983 |
| WO | WO 95/16794 | 6/1995 |
| WO | WO 96/10650 | 4/1996 |
| WO | WO 01/14594 | 3/2001 |
| WO | WO 01/14595 | 3/2001 |
| WO | WO 03/018848 | 3/2003 |
| WO | WO 2004/041003 A1 | 5/2004 |

OTHER PUBLICATIONS

A. Elmidaoui et al., "Removal of melassigenic ions for beet sugar syrups by electrodialysis using a new anion-exchange membrane", 2002 pp. 143-148.

Eszterle Matild, "New technologies in the sugar industry" Cukoripar Liv, 2001, vol. 54, pp. 4-10.

S. Kishihara et al., "Continuous chromatographic separation of sucrose, glucose and fructose using a simulated moving-bed absorber", vol. 94, No. 1128, 1992, pp. 305-308.

Florence Lutin, "Electrodialysis as a purification technology in the sugar industry", Zuckerindustrie 125, 2000, Nr. 6, pp. 444.

JP 11 035591, abstract, Derwent Publications Ltd., London GB, AN 1999-186299.

Sugar Technology Beet and Cane Sugar Manufacture, Bartens, Berlin (1998), p. 1088.

Handbook of Sugar Refining, John Wiley & Sons, Inc. (2000), p. 6, "A Manual for the Design and Operation of Sugar Refining Facilities".

* cited by examiner

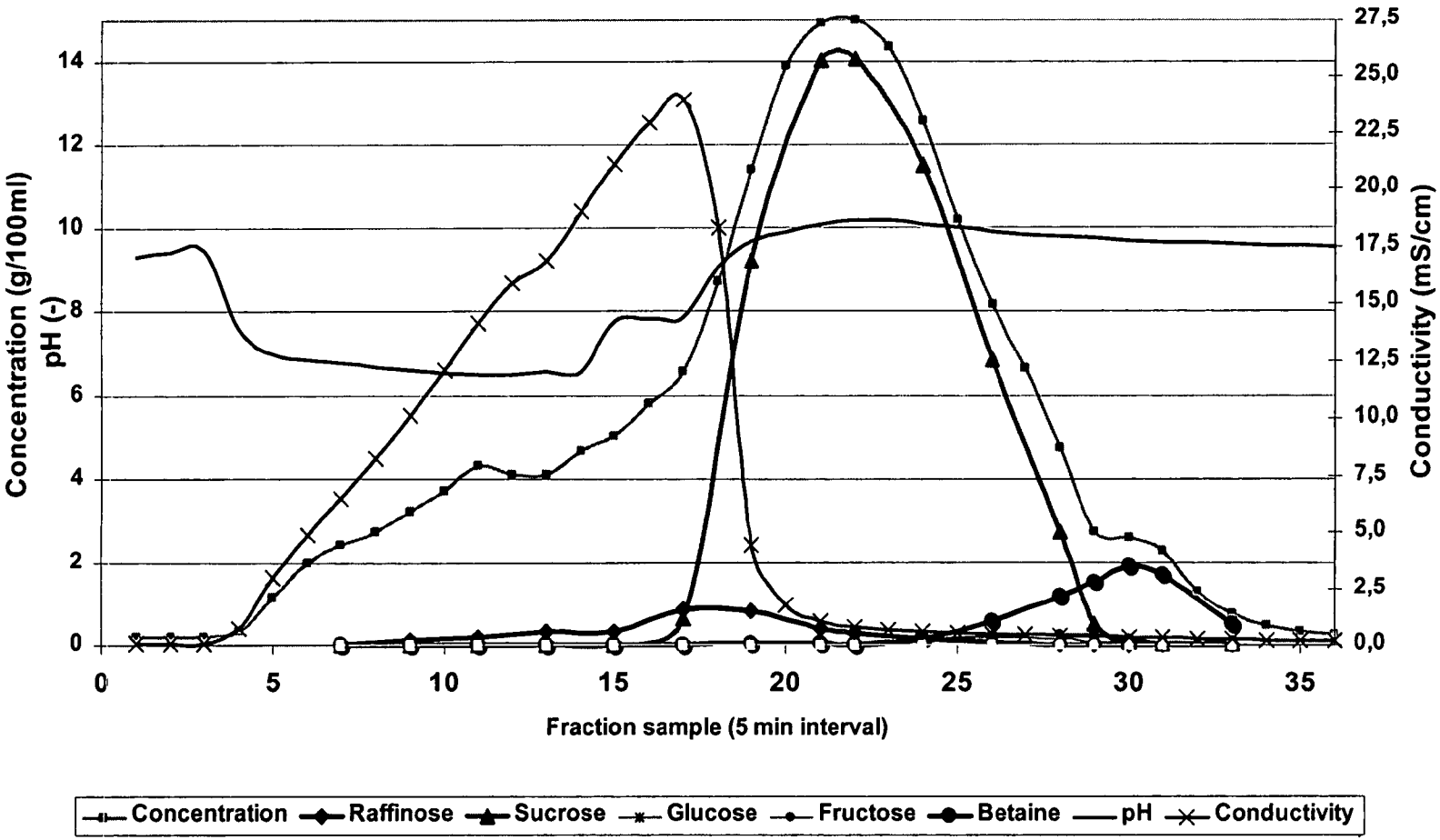
Figure 2. Separation profile of untreated molasses

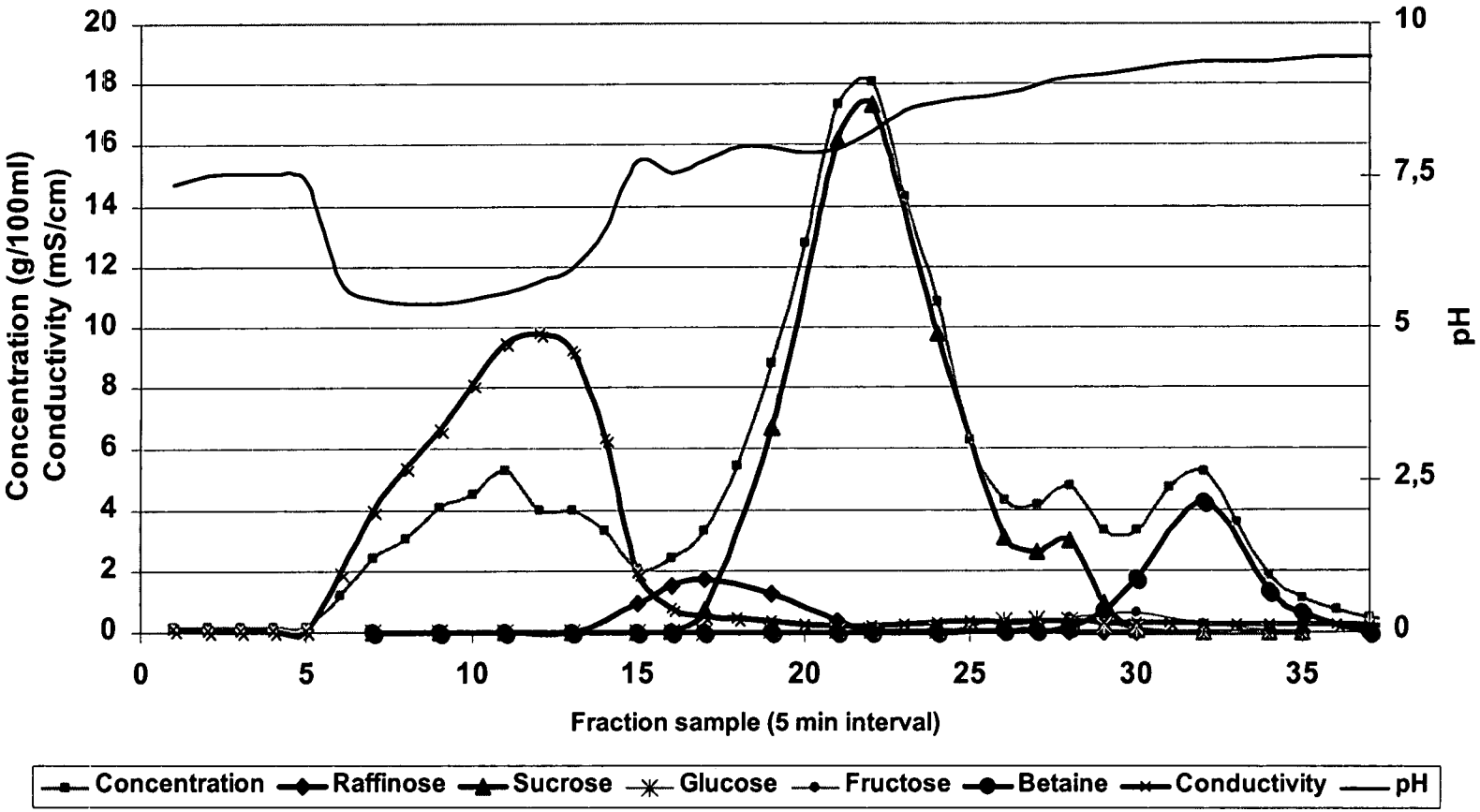
Figure 3. Separation profile of ED- D-molasses

PROCESS FOR THE RECOVERY OF SUCROSE AND/OR NON-SUCROSE COMPONENTS

CROSS REFERENCE TO RELATED APPLICATION

This application claims the benefit of Provisional Application No. 60/752,655, entitled "PROCESS FOR THE RECOVERY OF SUCROSE AND/OR NON-SUCROSE COMPONENTS" filed Dec. 21, 2005.

FIELD OF THE INVENTION

The present invention relates to a process for the recovery of sucrose and/or non-sucrose components from a sucrose-containing solution, and more particularly, to a process wherein electrodialysis is used. Further, the present invention relates to the use of electrodialysis in the recovery of sucrose and/or non-sucrose components.

BACKGROUND OF THE INVENTION

Electrodialysis (ED) as a technique is known from the 1950's and it is widely used for example in desalting of water and whey and within the inorganic chemical industry e.g. for recovering organic acids from solutions. Desalting of sugar cane or sugar beet solutions via ED has been established on 1960's to 80's in various patent publications. Electrodialysis separates salts from a sugar solution using alternative cation and anion exchange membranes. This is done by passing a direct current through a membrane stack, causing the anions to move through the anion exchange membrane and the cations through the cation exchange membrane. The cations cannot move through the anion exchange membrane.

U.S. Pat. No. 3,799,806 discloses a process for the purification and clarification of sugar juices, involving ultrafiltration followed by purification with electrodialysis. Sugar is separated by crystallization from the purified juice.

U.S. Pat. No. 3,781,174 discloses a continuous process for producing refined sugar from juice extracted from sugarcane. This process comprises further removing the impurities and colouring matter by using a combination of ion-exchange resin and ion-exchange membrane electrodialysis, concentrating the purified juice and crystallizing the concentrated juice to form refined sugar.

U.S. Pat. No. 4,331,483 discloses a process for purifying beet juice by contacting the juice to be purified with at least two ion exchangers formed of a porous mineral support covered with a film of cross-linked polymer containing or bearing quaternary ammonium salt groups for at least one of the ion exchangers and sulfone groups for at least one of the other ion exchangers. The ion exchange is used for removing proteins, amino acids and betaine. Further, the purified juice might be demineralized by ion exchange or electrodialysis. Sugar is then separated by crystallization from the purified juice.

U.S. Pat. No. 4,083,732 discloses a method of treating fresh sugar juice at about room temperature which includes removing non-sugar impurities, concentrating the resulting cold, water white juice by reverse osmosis to form a syrup which is evaporated to form direct white sugar and edible molasses. Also a method of removing ions from the syrup by electrodialysis to produce edible molasses is disclosed.

Thus, electrodialysis is well known as a method for desalinating sugar cane syrup or molasses of a relatively high concentration. In case of sugar syrup or molasses, however, it has been considered defective in that organic non-sugar contents would adhere to and precipitate on the anion exchange film and make cleaning of films difficult. A method for the reduction of fouling by the precipitation of calcium and silicon before electrodialysis is disclosed in U.S. Pat. No. 4,492,601. It describes a process for clarifying and desalinating sugar cane syrup or molasses, wherein inorganic oxy-acid and organic acid impurities are removed from raw sugar cane or molasses solutions by the steps of (1) admixing with the raw sugar cane syrup or molasses solution a water-soluble chloride of an alkaline earth metal ion which reacts with inorganic oxy-acid anions and radicals and with organic acids to form a water-insoluble precipitate of said oxy-acid anions and radicals and organic acids, (2) separating said precipitate from said solution, (3) diluting the precipitate-free solution, and (4) subjecting said diluted solution to an electrodialysis using cation exchange film and neutral film arranged in an alternating manner.

However, ED has not commonly been used until late 1990's in sugar industry due to its high capital costs and due to fouling problems caused by anion products removed by ED from molasses. Various extensive pre-treatment methods to overcome the fouling problem have been patented, e.g. U.S. Pat. No. 4,711,722 and JP 58-082124.

The development of fouling resistant and high temperature resistant anion exchange membranes and the design of electrodialysis stacks has facilitated the economical use of ED in the sugar industry. Eurodia Industrie S.A. has established commercially viable ED technology for desalting of cane molasses, sugar beet syrup and liquid sugar. Lutin describes electrodialysis as a purification technology in the sugar industry especially to partially replace ion exchange resins for the demineralization and purification of sugar syrups (Zuckerindustrie 125, No 12, pp. 982-984, 2000 by Lutin). It should be noted that ion exchange technology does not provide an identical result to ED and that the regeneration of ion exchange resins necessarily involves the use of strong acids and bases while the ED resins are easily cleaned occasionally by an acid wash followed by an alkali wash with less chemicals than in ion exchange.

Further, alkali metal cations have been suspected of being highly melassigenic by holding sugar in the molasses and preventing it from being recovered as crystalline sugar. Elmidaoui et al. (Elsevier, Desalination 148, 2002, pp. 143-148) describe the removal of melassigenic ions especially $Na^+$, $K^+$ and $Ca^{2+}$ for beet sugar syrups by electrodialysis using an anion-exchange membrane.

However, none of the above-mentioned prior art discloses a process wherein chromatographic separation is utilized.

Chromatographic separation has been used in the sugar industry e.g. to recover sucrose, betaine and/or raffinose from sugar solutions, such as molasses. U.S. Pat. Nos. 5,795,398 and 6,224,776 describe prior art processes for such recovery.

The article "New technologies in the sugar industry" by Matild Eszterle (Cukoripar liv, vol 54, (2001) No 1, pp 4-10) discloses separation techniques used in sugar industry including chromatography and electrodialysis. These techniques are disclosed as alternatives for the purification of sugar juices. This article does not disclose any specific combination of these techniques and it is only directed to provide a method which would decrease the amount of energy consuming crystallization steps.

U.S. Pat. No. 6,406,547 discloses a process for producing sugar from beets comprising multiple steps including two separate ultrafiltration steps. In this process the second ultrafiltration permeate is nanofiltered. The nanofiltration retentate can be used in evaporation and crystallization operations to produce crystals of white sugar. The process can optionally include ion exchange and/or electrodialysis purification steps, prior to or after the nanofiltration step. Recycle syrups can be treated with a chromatographic separator to remove raffinose from the sugar solution.

It is also known in the art to use electrodialysis to remove salts from corn fiber hydrolyzate before a simulated moving bed ("SMB") chromatographic separation step (U.S. Pat. No. 6,586,212 or U.S. Pat. No. 6,352,845).

Despite the advances made in the art, there exists a continued need for the development of novel processes for the separation and recovery of sucrose and non-sucrose components from sugar beet and/or sugar cane origin. Specifically, many of the prior art approaches discussed hereinabove involve the use of electrodialysis alone for the purification, and are silent about the use of chromatographic separation. Thus, the prior art does not disclose electrodialysis treatment of a sucrose-containing solution selected from molasses and non-nanofiltered sugar juices and sugar liquors before chromatographic separation. The objective problem to be solved is to improve overall yield of components and to enable recovery of higher purity fractions of sucrose and/or non-sucrose components from said sucrose-containing solutions and/or higher resin capacity and reduced evaporation volumes in the chromatographic separation.

SUMMARY OF THE INVENTION

An object of the present invention is thus to provide a method and use so as to solve the above problems. The objects of the invention are achieved by a method and use which are characterized by what is stated in the independent claims. The preferred embodiments of the invention are disclosed in the dependent claims.

The invention is based on the idea of combining electrodialysis (ED) and chromatography of a sucrose-containing solution to improve the overall efficiency in recovery of sucrose and other by-products such as betaine from sucrose-containing solutions compared to using chromatography alone. The improved overall efficiency means e.g. higher purity of the products, higher production capacity, higher yield of the products, better resin productivity in chromatography, lesser energy consumption of the process, smaller apparatus, and/or higher amount of dry solids passing through process. It has surprisingly been found that the ED pre-treatment of sucrose-containing solution enables a better resolution of the compounds in the chromatographic separation and that product fractions with higher purity are obtained.

An advantage of the method of the invention is that the ED treatment of a sucrose-containing solution results in a purity increase following the salt removal, which allows more sugar to be crystallized after the chromatographic separation. It is also an advantage of the invention that in the chromatographic separation the resolution of non-sucrose components, such as raffinose and betaine, will be improved due to the ED-treatment. Thus, the purity of these fractions will increase. This offers a potential to recover raffinose along with sucrose and betaine. Therefore, it is an object of the invention to provide a method, which enriches non-sucrose components to separate fractions, i.e. produces purer product fractions.

Another advantage of the present process is the reduced energy requirement caused by the reduced amount of dry solids fed to the chromatographic separation and as a consequent reduced need for evaporation of the enriched product fractions.

The idea in the preferred embodiment of the invention is to combine electrodialysis (ED), crystallization and simulated moving bed chromatography of molasses to improve the overall efficiency in the recovery of sucrose and other by products, such as betaine, compared to using chromatography alone. Performing ED and crystallization before chromatographic separation reduces the amount of dry solids to the chromatographic separation. Due to the higher peak concentrations of sucrose, betaine and raffinose fractions the volumes to be evaporated from these fractions will be reduced, and thus the energy requirement is reduced.

BRIEF DESCRIPTION OF THE DRAWINGS

In the following the invention will be described in greater detail by means of preferred embodiments with reference to the attached drawings, in which

FIG. 2 shows the chromatographic separation profile of a batch test of untreated molasses.

FIG. 3 shows the chromatographic separation profile of a batch test of ED-D-molasses.

DETAILED DESCRIPTION OF THE INVENTION

Figure 1:
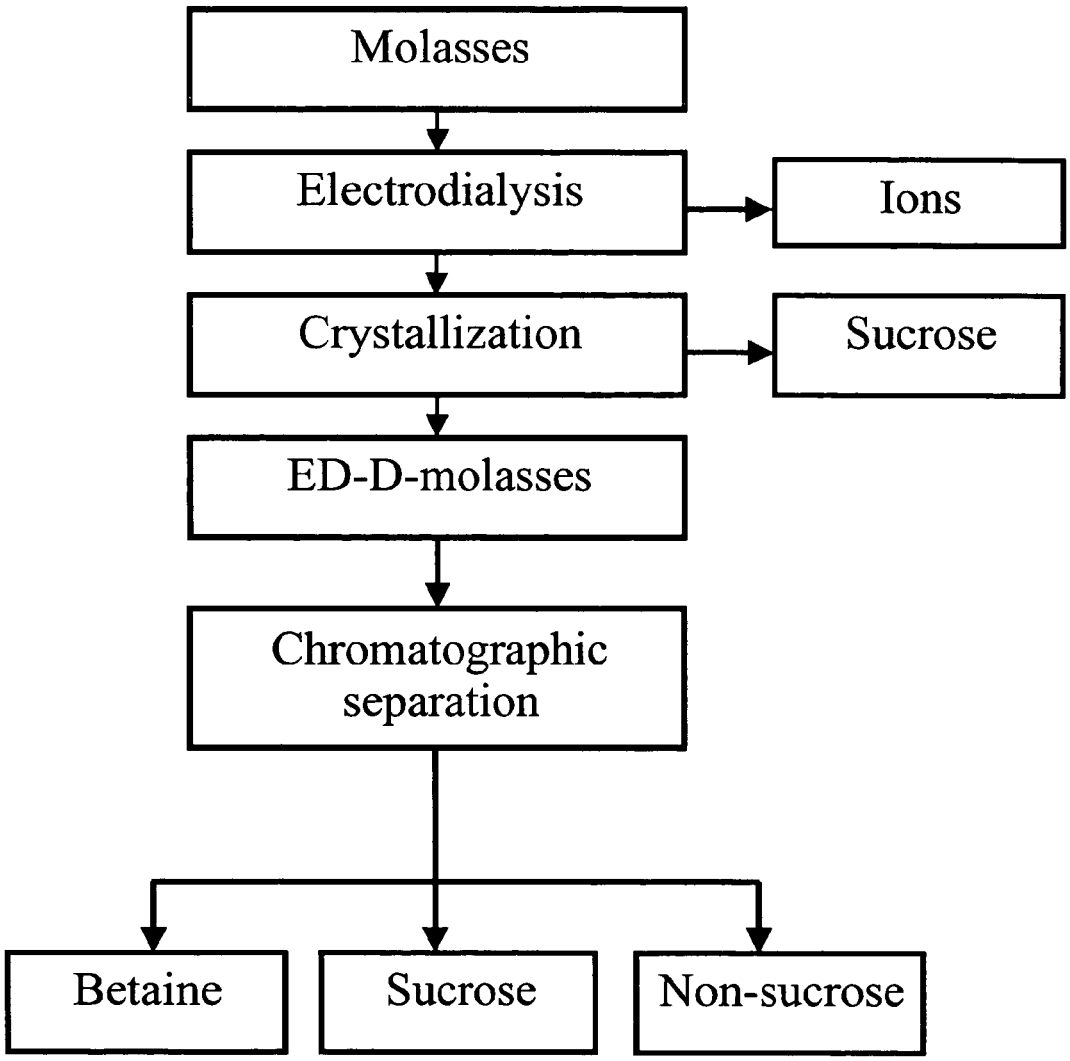
FIG. 1 is a schematic flow sheet of the inventive process according to an embodiment.

The present inventors have surprisingly found that the efficiency of the recovery of sucrose and/or non-sucrose components of sugar beet and/or sugar cane origin can be improved by the use of ED-treatment before a chromatographic step.

The present invention relates to an industrially useful process for the recovery of sucrose and/or non-sucrose components comprising

- providing a solution of sugar beet and/or sugar cane origin selected from molasses, sugar juices and liquors, wherein said sugar juices are non-nanofiltered during the process;
- subjecting said solution to electrodialysis for removing therefrom inorganic and organic anions and cations and organic acids;
- subjecting the electrodialyzed solution to a chromatographic separation for obtaining sucrose and non-sucrose components in separate fractions; and
- recovering a product selected from sucrose and non-sucrose components from at least one of said fractions.

Molasses is defined according to Sugar Technology Beet and Cane Sugar Manufacture (Bartens, Berlin 1998, p. 1088) as the sugar-bearing product of the sugar end whose purity has been reduced to the point that further crystallisation of sugar is not economically feasible without special treatment of molasses. According to Handbook of Sugar Refining (A Manual for the Design and Operation of Sugar Refining Facilities, John Wiley & sons, Inc 2000, page 6) molasses is defined as sugar-bearing product of the sugar end, whose purity has been reduced to the point that further crystallisation of sugar is not possible. European Union has in its regulation defined that food grade molasses must contain less than 70% of DS of sugars (saccharose or its degradation products and other sugars like raffinose) to qualify as a molasses within EU-regulations. In connection with the present invention molasses according any of the above definitions or according any other known definition are considered as molasses.

Chromatography is widely used to commercially recover sucrose and other components such as betaine from especially beet molasses. The present invention combines the use of electrodialysis (ED) with chromatographic separation to improve the recovery of sucrose and other components from sucrose-containing solutions, especially from molasses. ED is used to increase the purity of a sucrose-containing solution by removing salts.

In the general process of the present invention sucrose and/or non-sucrose components are recovered by an industrially useful process from a solution of sugar beet and/or sugar cane origin, said solution being selected from molasses, sugar juices and liquors. During the process of the present invention said sugar juices are non-nanofiltered. The solution of sugar beet and/or sugar cane origin is hereinafter referred to as a sucrose containing solution. This solution is subjected to electrodialysis (ED) for removing therefrom inorganic and organic anions and cations and organic acids. The removal of said components by ED improves the performance of the chromatographic separation so that the peak shape is sharper and the concentration of specific components in a peak is higher, i.e. the resolution between peaks improves. The effect of ED significantly improves the chromatographic separation performance enabling the separation and recovery of higher purity fractions and/or much higher resin capacity (calculated as dry solids per hour per $m^3$ of resin). The obtained electrodialyzed solution is subjected to a chromatographic separation for obtaining sucrose and non-sucrose components in separate fractions. Finally a product selected from sucrose and non-sucrose components from at least one of said fractions is recovered. For example, the sucrose extract (=fraction) can be recovered and refined to provide white sugar. Also betaine and raffinose can be recovered as separate fractions.

In an embodiment of the invention the sucrose-containing solution comprises molasses of sugar beet and/or sugar cane origin, and preferable said molasses contains sucrose less than 70% on the dry substance. Such a solution is generally considered to be unsuitable for recovery of sucrose by crystallization.

In another embodiment of the invention the sucrose-containing solution is sugar juice or liquor, which is selected from raw juice, thick juice, thin juice and mother liquor, said juice or liquor being of sugar beet or sugar cane origin. In this specification the mother liquor means any liquid in which sugar crystals have been formed and have been removed. The sugar juice used in the process is not nanofiltered, as in the prior art, since nanofiltration is a superfluous step which greatly dilutes the feed solution and increases the need for later evaporation and leads to losses of betaine and other smaller compounds.

The preferred non-sucrose components comprise betaine, raffinose, invert sugar, amino acids, inositol and combinations thereof.

In another embodiment of the invention the process comprises a further step, wherein said electrodialysis is followed by at least one crystallization before said chromatographic separation, said crystallization providing crystallized sucrose and electrodialyzed solution. The crystallization separates the sugar from the organic and inorganic components in the sugar solution allowing the sugar crystals to be separated by centrifugation. The recovery of sugar from the ED-treated sucrose-containing solution significantly reduces the amount of dry solids to be treated by chromatography, thus increasing capacity and reducing operating costs or reducing investment costs for a new system. The reduction in weight of dry solids typically obtainable by the use of ED before chromatography is in the order of 20% and this weight is further significantly reduced by the crystallization step.

The removal of sugar from the feed solution by crystallization reduces the sugar content and increases the relative concentration of the non-sugar components in the feed to the chromatographic separation. This enables the non-sucrose fractions, especially betaine and raffinose, to be recovered at a strikingly good yield and purity compared to the prior art. In addition to that sucrose can be recovered with a high yield and purity to the sucrose fraction to be crystallized therefrom.

Removal of the inorganic and organic anions and cations and organic acids from the sucrose-containing solution by ED provides a solution from which sucrose can still be recovered by crystallization even though the concentration of sucrose in the solution is low, i.e. below 70%.

The ED treatment of a sucrose-containing solution also results in a purity increase following the removal of inorganic and organic anions and cations and organic acids, which allows more sugar to be crystallized after the chromatographic separation. Without wishing to be tied to any theory, it is believed that the improved crystallization behaviour of sucrose observed in the invention is due to the removal by ED of components, which would otherwise have been projected onto the sucrose peak in the chromatography thus reducing the purity of the peak. Prior to the present invention it was not known how the various innumerable components of the sucrose solution would behave in the ED treatment and how the remaining components would affect the chromatographic separation profile.

The crystallization performed after the ED may be done by evaporative boiling crystallization (e.g. at 80° C.), cooling crystallization (e.g. down to 40° C.) or combinations thereof. The crystallizer may be operated batchwise or continuously. A combination of evaporative and cooling crystallization is the preferred technique in the present invention.

In one embodiment of the invention the sucrose-containing solution comprises beet molasses. This solution is electrodialyzed and then crystallized and the crystallized sucrose is recovered and refined to provide white sugar and secondary electrodialyzed molasses.

The chromatographic separation in the process of the invention may comprise a separation selected from batch separation, continuous simulated moving bed separation and sequential simulated moving bed separation. The development of SMB chromatography has enabled industrial application of this technology to become economically viable for recovery of sucrose and betaine from beet molasses. Therefore simulated moving bed (SMB) chromatography is widely used to commercially recover sucrose and other components such as betaine from especially beet molasses. The SMB mode of operation offers much greater resin efficiency than the original batch systems with the same amount of resin capable of treating 2 to 3 times more molasses. The processing of pretreated molasses de-ashed by ED offers the potential for better and more cost effective performance through capacity improvements and better peak resolutions.

The chromatographic fractionation of the process of the present invention may be carried out using a column packing material selected from cation and anion exchange resins. The resins are used in a gel form or in a macroporous form. In a preferred embodiment of the invention, said resins are strongly acid exchange resin in a gel form.

In a preferred embodiment of the invention, the chromatographic fractionation is carried out with cation exchange resins. The cation exchange resins may be selected from strongly acid cation exchange resins or weakly acid cation exchange resins.

Said strongly acid cation exchange resins may be in a monovalent cation form or in a divalent cation form. In a preferred embodiment of the invention, said strongly acid cation exchange resin is e.g. in $Na^+$ or $Ca^{2+}$ form.

Said strongly acid cation exchange resin may have a styrene skeleton. In a preferred embodiment of the invention, the resin is a sulphonated polystyrene-co-divinylbenzene resin. Other alkenylaromatic polymer resins, like those based on monomers like alkyl-substituted styrene or mixtures thereof, may also be applied. The resin may also be crosslinked with other suitable aromatic crosslinking monomers, such as divinyltoluene, divinylxylene, divinylnaphtalene, divinylbenzene, or with aliphatic crosslinking monomers, such as isoprene, ethylene glycol diacrylate, ethylene glycol dimethacrylate, N,N'-methylene bis-acrylamide or mixtures thereof. The cross-linking degree of the resin is typically from about 1% to about 20%, preferably from about 3% to about 8%, of the crosslinking agent, such as divinyl benzene.

The average particle size of the resins which are useful in the present invention is normally 10 to 2000 micrometers, preferably 100 to 400 micrometers. In a preferred embodiment of the invention, the resins are gel-type resins.

Manufacturers of the resins include, for example, Finex Oy, Purolite, Dow Chemicals, Bayer AG and Rohm & Haas Co.

In the chromatographic fractionation operation, the cations of the resin are preferably in substantial equilibrium with the cations of the mobile phase of the system and/or with the feed material of the system.

The eluent used in the chromatographic fractionation is preferably water, but solutions of salts and water are also useful. Furthermore, condensates obtained from the evaporation (concentration) of the product fractions from the chromatographic separation are useful eluents.

The temperature of the chromatographic fractionation is typically in the range of 20° C. to 90° C., preferably 40° C. to 65° C. The pH of the solution to be fractionated is typically in the range of 2 to 9.

The chromatographic fractionation may be carried out using all known modifications of the chromatographic fractionation, typically as a batch process or a simulated moving bed process (SMB process). The SMB process is preferably carried out as a sequential or a continuous process.

In the simulated moving bed process, the chromatographic fractionation is typically carried out using 2 to 14 columns connected in series and forming at least one loop. The columns are connected with pipelines. The flow rate in the columns is typically 0.5 to 10 $m^3/(hm^2)$ of the cross-sectional area of the column. Columns are filled with a column packing material selected from the resins described above. The columns are provided with feed lines and product lines so that the feed solution and the eluent can be fed into the columns and the product fractions collected from the columns. The product lines are provided with on-line instruments so that the quality/quantity of the production flows can be monitored during operation.

During, the chromatographic SMB separation, the feed solution is circulated through the columns in the loops by means of pumps. Eluent is added, and the product fraction containing the desired monosaccharide, other optional product fractions and residual fractions are collected from the columns.

In the batch process, the feed solution and the eluent are fed to the top of the column system and the product fractions are collected from the bottom of the system.

Before the chromatographic fractionation, the feed solution may be subjected to one or more pretreatment steps selected from softening by ion-exchange treatment, dilution, concentration e.g. by evaporation, pH adjustment and filtration, for example. Before feeding into the columns, the feed solution and the eluent are heated to the fractionation temperature described above (for instance in the range of 50° C. to 85° C.).

A further embodiment of the invention combines the use of electrodialysis and crystallization techniques with that of chromatographic separation to improve the recovery of sucrose and other components from sucrose-containing solution. ED is used to increase the purity of sucrose-containing solution by removing salts, which allows sucrose to be further crystallized from the molasses. The combined effect of ED and crystallization not only significantly reduces the amount of dry solids to be treated by SMB but also significantly improves the chromatographic separation performance as mentioned earlier.

The operation conditions of the electrodialysis step comprise preferably feeding the solution through anion and cation exchange membranes, which operate at 40° C. to 100° C., preferably 55° C. to 65° C. Examples of suitable commercially available membranes comprise the anion exchange membrane Neosepta AXE01 and the cation exchange membrane Neosepta CMX. The solution subjected to electrodialysis preferably has a pH of 7 to 9 going in and a pH of 4 to 7 coming out of the electrodialysis.

Preferably the electrodialysis removes 60% or more, more preferably 75% or more, and most preferably 90% or more of the inorganic and organic anions and cations and organic acids initially contained in said solution. In a typical electrodialysis treatment, about 80% to 85% of the ash (measured as conductivity) is removed.

The process of the invention might comprise a number of further steps. For example, the solution may be subjected to a treatment selected from dilution, filtration, softening and combinations thereof before or after electrodialysis and before being subjected to the chromatographic separation.

In one embodiment of the invention the sucrose-containing feed solution of beet molasses is subjected to electrodialysis, crystallization and chromatographic separation, in that order, and a product selected from sucrose and non-sucrose components of sugar beet and/or sugar cane origin is/are recovered after said chromatographic separation.

The solution subjected to crystallization after electrodialysis may have a sucrose content of 65% to 75% on the dry substance. In a preferred embodiment of the invention, as much of said sucrose as can be recovered at high purity (typically less than 50% of said sucrose), is recovered in the post-electrodialysis crystallization. The rest of the sucrose will be retained in a sucrose fraction obtained in said chromatographic separation and the sucrose may yet again be recovered at high purity and high yield by crystallization from said fraction.

In a preferred embodiment the total yield of sucrose recovered from the feed solution of molasses is significantly improved compared to the yield of a similar chromatographic separation and crystallization without electrodialysis. Achieved total sucrose yield from molasses as crystalline sucrose may be over 85% and advantageously over 90% on available sucrose in molasses. It is also preferred that a fraction containing a non-sucrose component selected from betaine and raffinose is recovered after said chromatographic separation. The purity of the fraction of said non-sucrose component recovered from said feed solution is significantly improved compared to the purity of a similar fraction from a chromatographic separation without electrodialysis. The purity of the products is a result of efficiency of the process. It is further preferred that the amount of dry solids of the solution subjected to chromatographic separation is significantly reduced compared to the amount subjected to chromatographic separation in a similar process without a preceding electrodialysis and crystallization.

The purity of the sucrose recovered from said fraction is typically 90% to 95% on the dry substance.

The purity of said raffinose fraction is typically from 40% to 70%, preferably from 55% to 65% on the dry substance.

The purity of said betaine fraction is typically from 65% to 80% on the dry substance.

The sucrose component recovered according to the process of the invention may be further processed to a suitable end product such as caster sugar (also known as table sugar, fine sugar or superfine sugar), decorating sugar (also known as crystal sugar or sanding sugar), granulated sugar, icing sugar (also known as confectioner's sugar), jam sugar, lump sugar (also known as sugar cubes), liquid sugar, gelling sugar, instant sugar, nib sugar sugars with flavours e.g. cinnamon and cocoa or coloured sugar crystals. Syrups and organic sugars and syrups can also be produced.

The present invention relates also to the use of electrodialysis for improving the efficiency of chromatographic separation in the industrial recovery of sucrose and/or non-sucrose components. As mentioned above the chromatographic separation may be selected from batch separation and continuous separation. Preferably said continuous separation is selected from a simulated moving bed (SMB) method and a sequential simulated moving bed method. In one embodiment of the invention the simulated moving bed method is performed in a process, wherein the separation process comprises at least two separation profiles in the same loop as described e.g. in U.S. Pat. No. 6,224,776.

In an embodiment of the invention the total yield of sucrose in a sucrose recovery process is increased by pretreating a sucrose-containing solution by electrodialysis prior to subjecting it to chromatographic separation, compared to a similar process without electrodialysis. In a further embodiment said electrodialysis is followed by crystallization of sucrose before said chromatographic separation.

In the use of the invention the fraction purity of non-sucrose components selected from betaine and raffinose is preferably increased by improving the resolution of sucrose and said components in said chromatographic separation, compared to a similar process without electrodialysis, and further the volume of solution fed into a chromatographic separation step in a given process is preferably significantly reduced by pretreating said feed solution with electrodialysis and crystallization.

The use of electrodialysis according to the invention may be done so that the chromatographic separation is performed on a sucrose-containing solution treated or untreated by carbonation. Said sucrose-containing solution comprises preferably beet molasses. It is advantageous that the use of ED can eliminate the traditional carbonation pre-treatment needed for molasses before chromatographic separation. Carbonation means the removal of Ca and Mg with liming to prevent Ca-precipitation on separation resin columns.

In an embodiment of the invention as illustrated in FIG. 1, a solution of sugar beet molasses is subjected to electrodialysis (ED) for removing therefrom inorganic and organic salts and acids. The obtained electrodialyzed solution (ED-product molasses) is subjected to at least one crystallization (D-crystallization). The crystallization separates the sugar from the organic and inorganic components in the sugar solution. The sugar crystals are removed by centrifugation to provide crystallized sucrose (D-sugar) and electrodialyzed liquor (ED-D-Molasses). The crystallized sucrose (D-sugar) is recovered and refined by any conventional crystallization method to provide white sugar and secondary electrodialyzed molasses. The ED-D-molasses is subjected to a chromatographic separation for obtaining sucrose and non-sucrose components in separate fractions. The sucrose extract is recovered and refined to provide white sugar. Betaine and raffinose are recovered as separate fractions.

The invention is illustrated further in the following Examples. It should be understood that this is done solely by way of example and is not intended neither to delineate the scope of the invention nor limit the ambit of the appended claims.

EXAMPLES

Example 1

Example 1 comprises the following steps:

1) Electrodialysis (ED) of normal sugar beet molasses producing purified ED-molasses;

2) Evaporative and cooling crystallisation of the purified ED-molasses producing an ED-D-massecuite;

3) Centrifugation of the ED-D-massecuite producing an ED-D-sugar and an ED-D-molasses exhausted of sugar and of similar sucrose purity to normal factory molasses;

4) Refining of the ED-D-sugar to white sugar in the traditional way by re-dissolving and re-crystallisation;

5) Chromatographic separation of the ED-D-molasses and recovery of the sucrose and the non-sugar components or direct uses of the good tasting ED-D-molasses.

6) Crystallisation of the sucrose fraction and recovery of white sugar.

Molasses Composition

The beet molasses fed to the ED unit was analysed as follows:

TABLE 1

| Analysis of normal molasses | % On Refractometer Dry Substance (RDS) |
|---|---|
| Sucrose | 57.8 |
| Glucose | 0.03 |
| Fructose | 0.08 |
| Betaine | 5.3 |
| Raffinose | 2.2 |
| Lactic acid | 3.2 |
| Formic acid | 0.7 |
| Acetic acid | 1.0 |
| Pyrrolidone carboxylic acid | 1.2 |
| Sodium | 1.6 |
| Potassium | 4.6 |
| Calcium | 0.105 |
| Magnesium | 0.002 |
| Iron | 0.005 |

Electrodialysis

The feed molasses was first diluted from 78.7% refractometer dry substance (RDS) to about 30% RDS before being fed to the Electrodializer Pilot Plant using Neosepta AXE01 and CMX exchange membranes. An 80% reduction in conductivity from 20 to 4 mS/cm was achieved at an operating temperature of 55° C. using a current density of 7 mA/cm$^2$ and 1 V/cell. Analysis of the molasses before and after ED treatment gave the following results:

TABLE 2

| Analysis | Feed Molasses | ED Molasses |
|---|---|---|
| Dry solids, % (RDS) | 31.1 | 24.6 |
| Sucrosepurity, % on RDS | 57.8 | 71.2 |
| Conductivity ash % RDS | 12.0 | 2.5 |
| Colour, Icumsa | 44888 | 44112 |
| pH | 7.6 | 4.9 |
| Betaine, % on RDS | 5.3 | 6.3 |
| Raffinose, % on RDS | 2.2 | 2.7 |

ED increased the molasses sucrose purity by over 13% units. There was little colour removal. The pH of product molasses was reduced causing slight sucrose inversion. To minimize this undesired hydrolysis of sucrose to glucose and fructose the pH of the ED molasses was increased from 4.9 to 7.9 with sodium hydroxide. The ED molasses was evaporated in a falling-film evaporator from 24.6% to 68.3% RDS producing an ED product molasses.

Analysis of the ED brine showed sucrose levels of about 2% on RDS. A material balance showed a sucrose yield of 99.3%. The betaine and raffinose yields were estimated at 95.9% and 99.5%, respectively, from the material balance.

Crystallization

The ED product molasses was subjected to a single evaporative crystallization step under vacuum followed by cooling crystallization and centrifugation. The same method as used for third product crystallization in the traditional beet sucrose crystallization process was applied, where a molasses exhausted of sugar is produced from which the crystalline sugar is recovered by centrifugation.

A 300 liter pilot DDS type evaporative batch crystallizer with stirrer was used. The ED product molasses was concentrated under vacuum at 80° C. and seeded with sugar crystals, which were grown by further concentration for about ten hours and exhaustion of the ED product molasses of sucrose. After final concentration the massecuite was cooled at about 1° C./h under stirring down to a temperature of below 45° C. and centrifuged to produce ED-D sugar and ED-D-molasses.

Crystallisation Results

Analysis of the ED-D-molasses gave the following results:

TABLE 3

| | % On RDS |
|---|---|
| Sucrose | 57.9 |
| Betaine | 9.2 |
| Raffinose | 5.0 |
| Lactic acid | 0.3 |
| Formic acid | — |
| Acetic acid | 0.1 |
| Pyrrolidone carboxylic acid | 0.3 |
| Sodium | 0.6 |
| Potassium | 1.1 |
| Calcium | 0.06 |
| Magnesium | 0.006 |
| Iron | 0.007 |

The ED-D-sugar could be refined in the normal way to produce a refined sugar and the thus obtained secondary ED-D-molasses fraction blended to the ED-D molasses to maximize recovery of sucrose, betaine and raffinose in the chromatographic separation process. The sucrose yield of the crystallisation was 44% (calculated as 100% pure sucrose) calculated on recovered crystalline sucrose as percentage of fed sucrose (kg).

Chromatographic Separation

The ED-D-molasses raw material was diluted to RDS 60 g/100 g and the pH was adjusted to about pH 8 with NaOH. The sodium ion content was 0.5% on RDS before pH adjustment. After pH adjustment (pH 8.1) the solution was filtered through a press filter and diluted to RDS 35.4 g/100 g. The composition of the ED-D-molasses feed liquor was as follows:

TABLE 4

| Sugar components, betaine | % on RDS |
|---|---|
| Sucrose | 57.9 |
| Glucose | 1.1 |

TABLE 4-continued

| Sugar components, betaine | % on RDS |
|---|---|
| Fructose | 2.1 |
| Betaine | 9.2 |
| Raffinose | 5.0 |

The ED-D-molasses was subjected to a batch mode chromatographic separation to recover the sucrose and the betaine fractions. The separation tests were done using about 210 litres of separation resin, (a strong cation exchange resin, Finex CS 11 GC, 5.5 DVB-%) loaded into a pilot batch separation column having a diameter of 0.225 m. The resin was regenerated to $Na^+$ form with 5% NaCl and 10% NaCl. The resin was then washed with ion-exchanged water and backwashed before starting the separation tests.

The composition of the feed samples and the selected fraction samples were analyzed by High Performance Liquid Chromatography (HPLC), ($Na^+$ form column). The metal content of the feed solutions were analyzed with Induction Coupled Plasma (ICP) and organic acids with HPLC by using $H^+$ form column. Refractometric index (RDS), pH and conductivity were measured from all fraction samples and feed samples.

The separation profile for ED-D-molasses (FIG. 3) shows a better separation of salts, sucrose, raffinose and betaine from each other than for normal beet molasses (FIG. 2). Due to the improved resolution the purity of the raffinose peak was increased up to the level 60% on RDS of ED-D molasses from the level 13-15% on RDS of normal molasses.

The results of the capacity (kg dry solids/hi $m^3$ resin) calculations for ED-D-molasses are compared with those for normal untreated molasses for constant sucrose and betaine purities and recycle ratios as follows:

TABLE 5

| | Untreated molasses | ED-D-molasses |
|---|---|---|
| Feed interval, min | 145 | 140 |
| Sucrose yield, % | 82.7 | 94.3 |
| Sucrose purity, % on DS | 91.9 | 92.0 |
| Sucrose purity in residual fraction, % on DS | 19.4 | 8.6 |
| Betaine yield, % | 83.7 | 91.7 |
| Betaine purity, % on DS | 65.0 | 65.0 |
| Recycle ratio, % | 15.0 | 15.0 |
| Product capacity(*), kg/h/$m^3$ | 8.6 | 8.5 |
| Sucrose capacity, kg/h/$m^3$ | 4.1 | 4.6 |
| Betaine capacity, kg/h/$m^3$ | 0.5 | 1.2 |
| Fraction concentrations, DS g/100 ml | | |
| Residual | 4.7 | 3.9 |
| Front recycle | 13.8 | 9.5 |
| Sucrose | 13.2 | 12.7 |
| Back recycle | 6.8 | 4.1 |
| Betaine | 1.4 | 4.2 |

(*)Residual, sucrose and betaine fractions (excluding recycle fractions)

The above results show an advantage of ED-treatment on sucrose and betaine yields when the recycle ratio and the sucrose and betaine purities were kept constant. With ED-D-molasses sucrose and betaine yields were about 94% and about 92%, respectively. Sucrose purity in the residual fraction was less than about 9%. For normal untreated molasses sucrose and betaine yields were about 83% and about 84%, respectively, and the sucrose purity in the residual fraction was about 19%.

Product capacity was the same for both normal and ED-treated molasses because of constant recycle ratios but the capacity for the betaine fraction was greater with ED-D-molasses due to the better resolution between sucrose and betaine. Also the capacity of the sucrose fraction was a bit better with ED-D-molasses. Concentrations of recycle fractions were lower with ED-D-molasses, which requires more evaporation before the fractions could be recycled back to the process. Concentration of the betaine fraction was three times greater with ED-D-molasses.

When sucrose and betaine yields and purities were kept constant the differences between the separations can be seen in recycle ratios and capacities as follows:

TABLE 6

| | Untreated molasses | ED-D-molasses |
|---|---|---|
| Feed interval, min | 145 | 140 |
| Sucrose yield, % | 90.1 | 90.0 |
| Sucrose purity, % on DS | 92.0 | 92.0 |
| Sucrose purity in residual fraction, % on DS | 11.1 | 14.2 |
| Betaine yield, % | 90.0 | 90.0 |
| Betaine purity, % on DS | 65.0 | 65.6 |
| Recycle ratio, % | 20.7 | 13.6 |
| Product capacity(*), kg/h/m$^3$ | 8.0 | 8.7 |
| Sucrose capacity, kg/h/m$^3$ | 4.0 | 4.5 |
| Betaine capacity, kg/h/m$^3$ | 0.5 | 1.1 |
| Fraction concentrations, DS g/100 ml | | |
| Residual | 4.4 | 4.1 |
| Front recycle | 11.7 | 10.7 |
| Sucrose | 14.1 | 12.6 |
| Back recycle | 7.9 | 4.1 |
| Betaine | 1.4 | 4.2 |

(*)Residual, sucrose and betaine fractions (excluding recycle fractions)

When sucrose and betaine yields and purities were kept constant the differences between the separations can be seen in recycle ratios and capacities in the above results. The recycle ratio was much bigger for the normal untreated molasses (21% vs. 14%). This had an effect on product capacity, which for untreated molasses was 8.0 kg/h/m$^3$ compared to 8.7 kg/h/m$^3$ for ED-D-molasses. Also the capacity of the sucrose and the betaine fractions were better with ED-D-molasses. Also in this case concentrations of recycle fractions were lower with ED-D-molasses—bigger difference in back recycle concentrations. Betaine fraction concentrations were the same as in first case in table 5.

Overall Sucrose Yield

The overall sucrose yield from normal beet molasses by crystallization of the ED-molasses and sucrose fraction from chromatographic separation was calculated from the material balance according to figures in table 5; sucrose yield 94% and betaine yield 92%, as follows:

TABLE 7

| | | Sucrose, units | Sucrose Yield % |
|---|---|---|---|
| 1) | Start normal beet molasses | 455 | |
| 2) | Crystallisation of white sugar from ED-molasses | 200 | (44%) |
| 4) | Chromatographic separation of ED-D-molasses | 237 | (94%) |
| 3) | Crystallisation of white sugar from sucrose fraction | 219 | (92%) |
| | Total white sugar recovered | 419 | 92% |

The overall sucrose recovery from normal beet molasses was increased to 92% as a result of ED-treatment of the molasses prior to chromatographic separation. For normal beet molasses without ED-treatment total crystalline sucrose yield was 76% according to the reference example 2.

Overall Betaine Yield

The overall betaine yield to the betaine fraction from the ED-molasses was calculated from the material balances as follows:

TABLE 8

| | Betaine, units | Yield % |
|---|---|---|
| Start normal beet molasses | 42 | |
| Betaine fraction | 37 | 88% |

The overall recovery of betaine is 88%. The purity of the betaine fraction can be at least as high as 68% on DS with a good yield.

Example 2

Reference Example

Example 2 comprises the following steps:

1) Filtration and softening of normal sugar beet molasses;
2) Chromatographic separation of the molasses;
3) Recovery of sucrose and non-sugar fractions;
4) Crystallization of the sucrose fraction and recovery of white sugar.

Molasses Composition

The untreated molasses was pretreated by diluting to Brix 60 g/100 g and carbonating by pH adjustment with NaOH and addition of sodium carbonate. Afterwards the carbonated solution was filtered with a Seitz pressure filter. The pH of the feed solution was then adjusted to pH 8.9 before the chromatographic separation. Final dilution was done to 36.2 g RDS/100 g. Conductivity of the solution was 19.4 mS/cm and calcium content 0.006% on RDS. The composition of the prepared feed liquor was analyzed as follows:

TABLE 9

| Sugar components, betaine | % on RDS |
|---|---|
| Sucrose | 57.8 |
| Glucose | 0.8 |
| Fructose | 1.0 |
| Betaine | 5.3 |
| Raffinose | 2.2 |

The batch mode chromatographic separation tests were done using the same procedure as described in Example 1. The separation profile of the untreated molasses is shown in FIG. 2. The results of the capacity calculations for normal untreated molasses for constant sucrose and betaine purities and recycle ratios (Table 5) showed sucrose and betaine yields of about 83% and about 84%, respectively. Sucrose purity in the residual fraction was about 19%. As explained in Example 1 these yields are lower than the sucrose and the betaine yields of about 94% and about 92%, respectively, than achieved with ED-D-molasses. The sucrose purity in the residual fraction for ED-D-molasses was less than about 9%.

When sucrose and betaine yields and purities were kept constant (Table 6) the recycle ratio is much bigger for the normal untreated molasses at 21% compared with 14% for ED-D-molasses. This affected product capacity, which for untreated molasses was 8.0 kg/h/m$^3$ compared to 8.7 kg/h/m$^3$ for ED-D-molasses. Also the capacity of the sucrose and the betaine fractions were lower for untreated molasses. The yields for normal molasses over the chromatographic separator were about 90% and about 90% for sucrose and betaine, respectively. The purity of the sucrose fraction was 92% (Table 6)

Overall Sucrose Yield

The overall sucrose yield from normal beet molasses by chromatographic separation and crystallization of the sucrose rich fraction of 94% purity is calculated from the material balance as follows:

TABLE 10

| | | Sucrose, units | Yield % |
|---|---|---|---|
| 1) | Start normal beet molasses | 455 | |
| 2) | Chromatographic separation to sucrose fraction | 378 | 83% |
| 3) | Crystallization of white sugar from sucrose fraction | 344 | 91% |
| | Total white sugar recovered | 344 | 76% |

The overall sucrose recovery from normal beet molasses is 76% compared to 92% when using ED-treatment of the molasses prior to chromatographic separation (see Table 7).

Overall Betaine Yield

The overall betaine yield from the ED-molasses is calculated from the material balances as follows:

TABLE 11

| | Betaine, units | Yield % |
|---|---|---|
| Start molasses | 42 | |
| Betaine fraction | 35 | 84% |

The overall betaine recovery from normal beet molasses is 84% compared to 88% when using ED-treatment of the molasses prior to chromatographic separation. The purity of the betaine fraction is also three units lower at 65% compared to 68% when using ED-treatment.

In these examples 1 and 2 the separation of untreated molasses and ED-D-molasses with $Na^+$ form SAC resin has been compared. Electrodialysis (ED) is a pre-treatment of the feed solution, which removes both inorganic and organic non-sugars. The tests showed that the use of ED-treatment prior to chromatographic separation can improve the separation performance.

The separation profile of the untreated molasses is shown in FIG. 2 and that of ED-D-molasses in FIG. 3. As it can be seen from the figures, the resolution is much better with ED-D-molasses. Salts, sucrose and betaine are well separated from each other. The elution of sucrose starts somewhat 10 minutes earlier in ED-D-molasses separation. There is a smaller "second" sucrose peak on the back slope of sucrose profile in all separations with ED-molasses.

With the untreated molasses sucrose and betaine peaks are much wider compared to the peaks in the separation with ED-D-molasses. Part of sucrose is eluting under betaine peak and also part of salts are eluting under sucrose peak in the separation of untreated molasses whereas with ED-D-molasses salts, sucrose and betaine separated almost as separate peaks from each other. With both molasses the elution of glucose and fructose starts before betaine partly overlapping with sucrose and betaine. Inositol and glycerol elutes almost at the same speed as betaine. Raffinose elutes as a very flat and wide peak in the untreated molasses separation.

Example 3

In this example the chromatographic separation was done using a Simulated Moving Bed (SMB) pilot plant. To provide sufficient ED-D-molasses for this test work crystallisation and centrifugation of the ED-molasses was done on a factory-scale.

In the SMB tests a 2-profile separation sequence was created and the separation results for the ED-D-molasses were compared with those obtained of the original untreated molasses.

Example 3 comprises the following steps:

1) Electrodialysis (ED) of normal untreated sugar beet molasses to produce a purified ED-molasses;

2) Evaporative crystallisation of the purified ED-molasses on factory-scale using a 30 m$^3$ batch vacuum pan to produce an ED-D-massecuite;

3) Cooling crystallisation of the ED-D-massecuite from 80° C. to 50° C. over 48 hours by natural cooling in a stirred strike receiver;

4) Centrifugation of the ED-D-massecuite by a continuous centrifuge producing an ED-D-sugar and an ED-D-molasses exhausted of sugar and which has similar purity to normal untreated factory molasses;

5) Refining of the ED-D-sugar to white sugar in the traditional way by re-dissolving and re-crystallisation;

6) Chromatographic separation of the ED-D-molasses using the sequential Simulated Moving Bed technique having a total bed length of 24 metres and recovery of the sucrose and the non-sugar components.

7) Crystallisation of the sucrose fraction and recovery of white sugar.

Molasses Composition

The beet molasses fed to the ED unit was analysed as follows:

TABLE 12

| Analysis of untreated molasses | % On RDS |
|---|---|
| Sucrose | 60.8 |
| Glucose | 0.2 |
| Fructose | 0.5 |
| Betaine | 6.6 |
| Raffinose | 2.8 |
| Sodium | 0.8 |
| Potassium | 4.5 |
| Calcium | 0.1 |
| Magnesium | 0.002 |
| Iron | 0.003 |

Electrodialysis

The feed molasses was diluted from 77.8% refractometer dry substance (RDS) to ~30% RDS before being fed to the Electrodializer Pilot Plant, EUR 20 B 200-10 using Neosepta AXE01 as anion exchange membrane and Neosepta CMX as cation exchange membrane. A 60% reduction in conductivity from 20 to 8 mS/cm was achieved at an operating temperature of 55° C. using a current density of 7 mA/cm$^2$ and 1 V/cell. Analysis of the molasses before and after ED gave the following results:

TABLE 13

| Analysis | Feed Molasses | ED-Molasses |
|---|---|---|
| RDS | 32.5 | 28.1 |
| Sucrose purity, % on RDS | 60.8 | 70.7 |
| Conductivity ash % RDS | 11.6 | 4.0 |

TABLE 13-continued

| Analysis | Feed Molasses | ED-Molasses |
|---|---|---|
| Colour, Icumsa | 62,370 | 69,120 |
| pH | 7.3 | 4.9 |

ED treatment increased molasses sucrose purity by almost 10% units. There was no colour removal. The pH of product molasses was immediately increased from 4.9 to 8.1 with sodium hydroxide to avoid sucrose inversion. The ED-molasses was evaporated in a falling-film evaporator from 28.1% to 74.6% RDS to produce ED product molasses.

Analysis of the ED brine showed a pol content of 6.7% on RDS. The material balance showed a sucrose yield of 98.3%. The betaine and raffinose yields were estimated at 76.0% and 82.4%, respectively, from the material balance.

Crystallisation

The ED product molasses was subjected to a single evaporative crystallisation at 80° C. in a 30 $m^3$ stirred vacuum pan with centre down-take. The same procedure as for final product crystallisation was used. The sugar crystals produced in the final massecuite were normal.

ED-D-Massecuite

The massecuite was discharged into a strike receiver tank and cooled naturally under stirring to 50° C. over a period of 48 hours. Thereafter the massecuite was centrifuged in a continuous machine. The sugar crystals were separated, dissolved and recycled to the white sugar boiling pans. Four tons of the ED-D-molasses separated from the sugar crystals was collected for chromatographic separation.

Analysis of the ED-D-molasses gave the following results:

TABLE 14

| Analysis of ED-D-molasses | % On RDS |
|---|---|
| Sucrose | 58.6 |
| Glucose | 0.3 |
| Fructose | 0.4 |
| Betaine | 8.4 |
| Raffinose | 3.9 |
| Sodium | 0.7 |
| Potassium | 2.3 |
| Calcium | 0.1 |
| Magnesium | 0.01 |
| Iron | 0.01 |

The results show that the ED-D-molasses have about 2% units lower sucrose content (58.6%) compared to the original untreated molasses (60.8%). The raffinose and betaine contents were clearly higher than in the untreated molasses.

Chromatographic Separation

The feed solutions to chromatographic separation were subjected to an ion exchange pretreament. The metal analyses showed a significantly lower $K^+$ ion content in the ED-D-molasses of 2.3% RDS compared to 4.5% RDS in the untreated molasses. Unlike Example 1, the calcium content was the same in both molasses. The calcium level was reduced by a common softening method. This was done by diluting the molasses material and filtering the solution through a press filter before passing over ion exchanger with cation exchange resin in the sodium form.

The ED-D-molasses and normal beet molasses were thereafter subjected to the sequential 2-profile SMB chromatographic separation to recover the sucrose and the betaine fractions. The separation tests were done using a total bed length of 24 metres consisting of six columns. The separation parameters were as follows:

TABLE 15

| | Molasses |
|---|---|
| Feed size, % of bed volume | 9-12 |
| Feed load, kg DS/$m^3$ | 59-84 |
| Feed concentration, % RDS | 50-55 |
| Temperature, ° C. | 80 |

The separation resin used in these tests was a strong cation exchange resin Dow 99K/350 having DVB content of 6%. The resin was regenerated into the $Na^+$-form and packing into the columns was done using an 8% NaCl solution.

Tests were done to establish how much higher separation capacity could be achieved for ED-D-molasses compared to untreated molasses. Separation tests were started with untreated normal molasses at a normal capacity of 30 kg RDS/$m^3$/h. However, when results showed surprisingly good separation performance the capacity was increased to 35 then to 42 kg RDS/$m^3$/h. The first separation test with ED-D-molasses was started at the high capacity of 42 kg RDS/$m^3$/h and then increased. The results were as follows:

TABLE 16

| Feed Material | Untreated molasses | ED-D-Molasses |
|---|---|---|
| Test | A | B |
| Feed load (kg DS/$m^3$) | 59.1 | 74.2 |
| Feed purity (sucrose % DS) | 60 | 59.0 |
| Feed, colour (pH 7) | 97,180 | 128,540 |
| (approx. delay time in a feed tank) | (9 days) | (2 days) |
| Feed pH | 7.14 | 7.4 |
| Residual RI-DS (g/100 g) | 6.8 | 8.2 |
| Residual evap. kg $H_2O$/h/$m^3$ | 192.3 | 184.2 |
| Sucrose yield (%) | 90.7 | 92.6 |
| Sucrose purity (% DS) | 94.2 | 93.2 |
| Sucrose, colour (pH 7) | 9,140 | 8,000 |
| Sucrose RI-DS (g/100 g) | 30.4 | 32.4 |
| Sucrose evap. kg $H_2O$/h/$m^3$ | 40.6 | 48.9 |
| Sucrose cap. (kg DS sucr/h/$m^3$) | 20.6 | 27.5 |
| Evap. kg $H_2O$/kg DS(sucr.) | 2.0 | 1.8 |
| Betaine yield (%) | 96.2 | 92.3 |
| Betaine purity (% DS) | 73.0 | 76.5 |
| Betaine RI-DS (g/100 g) | 7.3 | 8.9 |
| Betaine evap. kg $H_2O$/h/$m^3$ | 48.5 | 60.6 |
| Betaine cap. (kg DSbet/m3/h) | 2.1 | 3.6 |
| Evap. need $H_2O$/kg DS (bet) | 23.0 | 16.7 |
| Recycle purity (% DS) | 63.3 | 63.4 |
| Recycle ratio (%) | 14.1 | 9.6 |
| Cycle time (min) | 73.0 | 73.0 |
| Product cap* (kg DS/$m^3$h) | 41.8 | 55.1 |

*Residual, sucrose and betaine fractions (excluding recycle fractions)

In Test B with ED-D-molasses the product capacity was increased to 55 kg RDS/$m^3$/h, a rate 30% higher compared to untreated molasses. The sucrose fraction purity obtained was 93.2%. This was one purity unit lower than achieved for untreated molasses in Test A at the lower capacity of 41.8% kg RDS/$m^3$/h and seemingly caused by higher raffinose content. At the same time the sucrose capacity of ED-D molasses in test B was increased to 27.5 kg RDSsuc/$m^3$/h compared to 20.6 kg RDSsuc/$m^3$/h with the untreated molasses.

Betaine capacity increased from 2.1 to 3.6 kg RDS/$m^3$/h with ED-D-molasses and the evaporation need declined from 23 to 16.7 kg $H_2O$/$m^3$/h.

Colour values were higher in the ED-D-molasses due to different delay times in the heated feed tanks. The results show that the pre-treatment of molasses by ED can improve SMB chromatographic separation capacity by over 30% for sucrose and by 70% for betaine compared to the untreated molasses.

The present invention has been illustrated herein mainly as relating to the treatment of molasses, as it is believed that recovery of useful products from molasses has the best technical and commercial potential. However, it is obvious to those skilled in the art that similar technical benefits of increased purity, yield and/or capacity are obtainable by the application of the inventive process on other types of sucrose solutions.

The invention claimed is:

1. An industrially useful process for the recovery of sucrose, non-sucrose, or sucrose and non-sucrose components comprising providing a solution of sugar beet, sugar cane origin, or sugar beet and sugar cane origin selected from the group consisting of molasses, sugar juices and liquors, wherein said sugar juices are non-nanofiltered during the process;

subjecting said solution to electrodialysis for removing therefrom inorganic and organic anions and cations and organic acids;

subjecting the electrodialyzed solution to a chromatographic separation for obtaining sucrose and non-sucrose components in separate fractions; and recovering a product selected from sucrose and non-sucrose components from at least one of said fractions.

2. The process according to claim 1, wherein said electrodialysis is followed by at least one crystallization before said chromatographic separation, said at least one crystallization providing crystallized sucrose and electrodialyzed solution.

3. The process according to claim 1, wherein said solution of sugar beet, sugar cane origin, or sugar beet and sugar cane origin comprises molasses.

4. The process according to claim 3, wherein said molasses contains sucrose less than 70% on the dry substance.

5. The process according to claim 1, wherein said sugar juices are selected from the group consisting of raw juice, thick juice and thin juice, and said liquors are mother liquor.

6. The process according to claim 1, wherein said electrodialysis comprises feeding said solution through anion and cation exchange membranes, which operate at 40-100° C.

7. The process according to claim 1, wherein the solution subjected to electrodialysis has a pH of 7-9 going in to a pH of 4-7 coming out of the electrodialysis.

8. The process according to claim 7, wherein said electrodialysis removes 60% or more of the inorganic and organic anions and cations and organic acids initially contained in said solution.

9. The process according to claim 7, wherein said electrodialysis removes 75% or more of the inorganic and organic anions and cations and organic acids initially contained in said solution.

10. The process according to claim 7, wherein said electrodialysis removes 90% or more of the inorganic and organic anions and cations and organic acids initially contained in said solution.

11. The process according to claim 2, wherein said at least one crystallization is selected from evaporative boiling crystallization and cooling crystallization and combinations thereof.

12. The process according to claim 2, wherein said solution of sugar beet and/or sugar cane origin comprises beet molasses and said crystallized sucrose is refined to provide white sugar and secondary electrodialyzed molasses.

13. The process according to claim 1, wherein said electrodialyzed solution is subjected to a treatment selected from the group consisting of dilution, filtration, softening and combinations thereof before being subjected to said chromatographic separation.

14. The process according to claim 1, wherein said chromatographic separation comprises a separation selected from the group consisting of batch separation, continuous simulated moving bed separation and sequential simulated moving bed separation.

15. The process according to claim 1, wherein said non-sucrose components are selected from the group consisting of betaine, raffinose, invert sugar, amino acids, inositol and combinations thereof.

16. The process according to claim 1, wherein said solution of sugar beet, sugar cane origin, or sugar beet and sugar cane origin is beet molasses and is subjected to electrodialysis, crystallization and chromatographic separation, in that order, and a product selected from sucrose and non-sucrose components is recovered after said chromatographic separation.

17. The process according to claim 16, wherein the solution subjected to crystallization after said electrodialysis has a sucrose content of 65 to 75% on the dry substance and that up to 20% to 50% of said sucrose is recovered in said crystallization.

18. The process according to claim 16, wherein a fraction containing sucrose is recovered after said chromatographic separation and sucrose is recovered by crystallization from said fraction.

19. The process according to claim 18, wherein the total yield of sucrose recovered from said molasses feed solution is improved compared to the yield of a similar chromatographic separation and crystallization without electrodialysis.

20. The process according to claim 18, wherein the sucrose purity of said fraction is 92% to 95%.

21. The process according to claim 16, wherein a fraction containing a non-sucrose component selected from betaine and raffinose is recovered after said chromatographic separation and the purity of said fraction of said non-sucrose component recovered from said feed solution is improved compared to the purity of a similar fraction from a chromatographic separation without electrodialysis.

22. The process according to claim 21, wherein said non-sucrose component comprises raffinose and the purity of said raffinose fraction is from 40% to 70%, preferably from 55% to 65% on the dry substance.

23. The process according to claim 21, wherein said non-sucrose component comprises betaine and the purity of said betaine fraction is from 65% to 75% on the dry substance.

24. The process according to claim 16, wherein the amount of dry solids subjected to chromatographic separation is reduced compared to the amount subjected to chromatographic separation in a similar process without a preceding electrodialysis and crystallization.

25. The process according to claim 1, wherein the recovered sucrose component is further processed to caster sugar, decorating sugar, granulated sugar, icing sugar, jam sugar, lump sugar, liquid sugar, gelling sugar or coloured sugar crystals.

26. The process according to claim 6, wherein said electrodialysis comprises feeding said solution through anion and cation exchange membrances, which operate at 55-65° C.

* * * * *